US007066269B2

(12) United States Patent
Dallas et al.

(10) Patent No.: US 7,066,269 B2
(45) Date of Patent: Jun. 27, 2006

(54) CASING MANDREL WITH WELL STIMULATION TOOL AND TUBING HEAD SPOOL FOR USE WITH THE CASING MANDREL

(75) Inventors: L. Murray Dallas, Fairview, TX (US); Bob McGuire, Oklahoma City, OK (US)

(73) Assignee: H W C Energy Services, Inc., Houston, TX (US)

( * ) Notice: Subject to any disclaimer, the term of this patent is extended or adjusted under 35 U.S.C. 154(b) by 4 days.

(21) Appl. No.: 10/440,795

(22) Filed: May 19, 2003

(65) Prior Publication Data

US 2004/0231856 A1 Nov. 25, 2004

(51) Int. Cl.
*E21B 33/04* (2006.01)

(52) U.S. Cl. ..... 166/379; 166/75.13; 166/88.1; 166/89.1

(58) Field of Classification Search ..... 166/75.14, 166/75.13, 88.1, 89.1, 379, 382
See application file for complete search history.

(56) References Cited

U.S. PATENT DOCUMENTS 2,122,071 A * 6/1938 Rasmussen et al. ..... 285/123.4
2,150,887 A * 3/1939 Mueller et al. ..... 166/379
2,159,526 A * 5/1939 Humason ..... 166/68.5
3,343,603 A 9/1967 Miller
3,404,736 A * 10/1968 Nelson et al. ..... 166/89.1
3,675,719 A 7/1972 Slator et al.
4,353,420 A 10/1982 Miller
4,595,053 A * 6/1986 Watkins et al. ..... 166/209
4,804,045 A * 2/1989 Reed ..... 166/65.1
4,939,488 A 7/1990 Tsutsumi
4,993,488 A 2/1991 McLeod ..... 166/72
5,092,401 A 3/1992 Heynen
5,421,407 A * 6/1995 Thornburrow ..... 166/85.3
5,540,282 A 7/1996 Dallas
5,605,194 A 2/1997 Smith
5,660,234 A 8/1997 Hebert et al.
6,145,596 A 11/2000 Dallas
6,179,053 B1 1/2001 Dallas
6,196,323 B1 3/2001 Moksvold
6,220,363 B1 4/2001 Dallas
6,247,537 B1 6/2001 Dallas
6,289,993 B1 9/2001 Dallas
6,364,024 B1 4/2002 Dallas
6,447,021 B1 9/2002 Haynes
6,491,098 B1 12/2002 Dallas
6,595,297 B1 7/2003 Dallas
6,626,245 B1 9/2003 Dallas (Continued)

OTHER PUBLICATIONS

U.S. Appl. No. 10/251,149, entitled "Cup Tool for High Pressure Mandrel," filed Sep. 20, 2002.

(Continued)

*Primary Examiner*—David Bagnell
*Assistant Examiner*—Giovanna Collins
(74) *Attorney, Agent, or Firm*—Nelson Mullins Riley & Scarborough, LLP

(57) ABSTRACT

A casing mandrel for an independent screwed wellhead includes a pin thread adapted for engagement with a box thread of a well stimulation tool lockdown nut for securing the well stimulation tool against the casing mandrel top end. A well stimulation tool and a tubing head spool for use with the casing mandrel are also provided. Safety of well stimulation procedures is thereby improved and well completion time is significantly reduced.

8 Claims, 10 Drawing Sheets

U.S. PATENT DOCUMENTS

| | | | | |
|---|---|---|---|---|
| 6,695,064 | B1 | 2/2004 | Dallas | |
| 6,769,489 | B1 | 8/2004 | Dallas | |
| 6,817,421 | B1 | 11/2004 | Dallas | |
| 6,817,423 | B1 | 11/2004 | Dallas | |
| 6,820,698 | B1 | 11/2004 | Haynes | |
| 6,827,147 | B1 | 12/2004 | Dallas | |
| 2002/0070030 | A1* | 6/2002 | Smith et al. | 166/379 |
| 2002/0117298 | A1 | 8/2002 | Wong et al. | |

OTHER PUBLICATIONS

U.S. Appl. No. 10/327,268, entitled "Slip Spool and Method of Using Same," filed Dec. 20, 2002.
U.S. Appl. No. 10/336,911, entitled "Backpressure Adapter Pin and Methods of Use," filed Jan. 6, 2003.
U.S. Appl. No. 10/912,894, entitled "Backpressure Adapter Pin and Methods of Use," filed Aug. 6, 2004.

* cited by examiner

CASING MANDREL WITH WELL STIMULATION TOOL AND TUBING HEAD SPOOL FOR USE WITH THE CASING MANDREL

CROSS-REFERENCE TO RELATED APPLICATIONS

This application claims priority to Canadian Patent Application No. 2,428,613, filed in Canada with the Canadian Intellectual Property Office on May 13, 2003.

MICROFICHE APPENDIX

Not Applicable.

TECHNICAL FIELD

The present invention relates generally to wellhead assemblies and, in particular, to a casing mandrel with a well stimulation tool and tubing head spool for use with the casing mandrel to improve the safety of well stimulation procedures on wells equipped with independent screwed wellheads.

BACKGROUND OF THE INVENTION

Independent screwed wellheads are well known in the art and classified by the American Petroleum Institute (API). The independent screwed wellhead has independently secured heads for each tubular string supported in the well bore. Independent screwed wellheads are widely used for production from low-pressure productions zones because they are economical to construct and maintain.

It is well known in the art that low pressure wells frequently require some form of stimulation to improve or sustain production. Traditionally, such stimulation procedures involved pumping high pressure fluids down the casing to fracture production zones. The high pressure fluids are often laden with proppants, such as bauxite and/or sharp sand.

FIG. 1 illustrates a prior art independent screwed wellhead 20 equipped with a flanged casing pin adaptor 30 typically used for completing or re-completing a well equipped with an independent screwed wellhead 20. The independent screwed wellhead 20 is mounted to a surface casing (not shown). The independent screwed wellhead 20 includes a sidewall 32 that terminates on a top end in a casing bowl 34, which receives a casing mandrel 36. The casing mandrel 36 has a bottom end 38, a top end 40 and an axial passage 42 having a diameter at least as large as a casing 44 in the well bore. The casing 44 has a pin thread 46 that engages a box thread 48 in the bottom end 38 of the casing mandrel 36. A flanged casing pin adaptor 30 has a pin thread 47 that engages a box thread 49 in the top end of the axial passage 42 in the casing mandrel 36. The flanged casing pin adaptor 30 also includes a top flange 45 to which a high pressure valve or a blowout preventor (BOP) is mounted in a manner well known in the art.

In a typical well stimulation procedure, a casing saver (not shown), such as a casing packer as described in U.S. Pat. No. 993,488, which issued Feb. 19, 1991 to Macleod, is inserted through the BOP (not shown) and into the casing 44. The casing saver is sealed off against the casing 44 and high pressure fluids are injected through the casing saver into a formation of the well. While the casing saver protects the exposed top end of the casing 44 from "washout", it does not release the box thread 49 or the pin thread 47 from strain induce by the elevated fluid pressures generated by the injection of high pressure fracturing fluid into the well. In a typical fracturing operation, high pressure fluids are pumped into the well at around 9500 lbs per square inch (PSI). If "energized fluids" or high pumping rates at more than 50 barrels per minute are used, peak pressures can exceed 9500 PSI. In general, the threads retaining the flanged casing pin adaptor 30 in the casing mandrel 36 are engineered to withstand 7000 PSI, or less. Consequently, high pressure stimulation using the equipment shown in FIG. 1 can expose the flanged casing pin adaptor 30 to an upward pressure that exceeds the strength of the pin thread. If either the box thread 49 or the pin thread 47 fails, the flanged casing pin adaptor 30 and any connected equipment maybe ejected from the well and hydrocarbons may be released to atmosphere. This is an undesirable situation.

Furthermore, use of a casing saver to perform well completion or re-completion slows down operations in a multi-zone well because the flow rates are hampered by the reduced internal diameter of the casing saver. Besides, the casing saver must be removed from the well each time the fracturing of a zone is completed in order to permit isolation plugs or packers to be set to isolate a next zone to be stimulated. It is well known in the art that the disconnection of fracturing lines and the removal of a casing saver is a time consuming operation that keeps expensive fracturing equipment and/or wireline equipment and crews setting idle. It is therefore desirable to provide full-bore access to the well casing 44 in order to ensure that transitions between zones in a multi-stage fracturing process are accomplished as quickly as possible.

There therefore exists a need for a system that provides full-bore access to a casing in a well to be stimulated, while significantly improving safety of a well stimulation crew by ensuring that a hold strength of equipment through which well stimulation fluids are pumped exceeds fluid injection pressures by an adequate margin to ensure safety.

SUMMARY OF THE INVENTION

It is therefore an object of the invention to provide a system for stimulating a well equipped with an independent wellhead.

The system includes an improved casing mandrel, a well stimulation tool specifically adapted to be used with the improved casing mandrel, and a tubing head spool likewise adapted to be used with the improved casing mandrel.

The invention therefore provides a casing mandrel adapted to improve the safety of high-pressure well stimulation procedures on wells equipped with an independent screwed wellhead. The casing mandrel comprises a casing mandrel body having an annular shoulder adapted for mating engagement with a top flange of a casing bowl of the wellhead, an outer contour below the annular shoulder being adapted for mating engagement with a casing bowl of the wellhead. An axial passage extends from a casing mandrel bottom end to a casing mandrel top end of the casing mandrel body. The axial passage has a diameter at least as large as an internal diameter of a casing of a well to which the wellhead is mounted. The casing mandrel top end extends above the annular shoulder, and includes a pin thread adapted for engagement with a box thread of a well stimulation tool lockdown nut for securing the well stimulation tool against the casing mandrel top end.

The axial passage that extends from the casing mandrel bottom end to the casing mandrel top end further comprises a box thread to permit well tree components to be connected to the casing mandrel.

In one embodiment, the casing mandrel top end includes a secondary seal bore concentric with the axial passage and located above the box thread. The secondary seal bore has a diameter that is larger than the axial passage and a smooth inner surface adapted for sealing engagement with at least one pressure seal on an outer mating surface of the secondary seal barrel of the well stimulation tool.

In accordance with a further aspect to the invention, there is provided a well stimulation tool for use in high pressure stimulation of a well equipped with an independent screwed wellhead and a casing mandrel having a casing mandrel top end that includes a pin thread adapted for engagement with a box thread of a lockdown nut for securing the well stimulation tool against the casing mandrel. The well stimulation tool provides full-bore access to the casing of a well to which the wellhead is mounted. The well stimulation tool comprises a well stimulation tool mandrel having a tool mandrel top flange adapted to support a high pressure fracturing stack, a tool mandrel bottom end with a pin threaded portion adapted to engage a box thread in a top end of an axial passage through the casing mandrel, and an annular flange located above the pin threaded portion for rotatably supporting a lockdown nut.

The tool mandrel bottom end further comprises a secondary seal barrel located above the pin threaded portion and adapted to be received in a secondary seal bore in the casing mandrel top end. A one of the secondary seal barrel and the secondary seal bore includes at least one annular groove for receiving and retaining an elastomeric seal for providing a fluid seal between the secondary seal bore and the secondary seal barrel. The elastomeric seal is, for example, an O-ring.

The invention further provides a well stimulation tool for use in high pressure stimulation of a well completed using an independent screwed wellhead and equipped with a casing mandrel having a casing mandrel top end that includes a pin thread adapted for engagement with a box thread of a lockdown nut for securing the well stimulation tool against the casing mandrel top end, the well stimulation tool being adapted for use in combination with a blowout preventer and a blowout preventer protector to provide full-bore access to the casing of a well to which the wellhead is mounted. The well stimulation tool comprises a well stimulation tool mandrel having a tool mandrel top flange adapted to support the blowout preventer to which the blowout preventer protector is mounted, a tool mandrel bottom end adapted to retain a high-pressure fluid seal between the bottom end of the well stimulation tool and the top end of the casing mandrel, and an annular flange located above the bottom end of the well stimulation tool for rotatably supporting the lockdown nut.

The invention further provides a tubing head spool for use on a well completed using an independent screwed wellhead and equipped with a casing mandrel in accordance with the invention. The tubing head spool comprises a spool sidewall with the bottom end having a pin thread adapted to engage the box thread in the top end of the axial passage through the casing mandrel. A sidewall of the tubing head spool includes at least one port that communicates with the axial passage. The tubing head spool further includes a top end with a tubing bowl. A tubing mandrel is received in the tubing bowl, and a tubing bowl nut locks the tubing mandrel in the tubing bowl. The tubing bowl nut threadedly engages a pin thread at a top of the sidewall of the tubing head spool.

The tubing head spool further comprises an annular flange located above the pin thread adapted to engage the box thread in the top end of the axial passage through the casing mandrel. The tubing head spool further includes a lockdown nut adapted for threadedly engaging the pin thread on the casing mandrel top end to lock the tubing head spool to the casing mandrel. The lockdown nut is rotatably retained on the tubing head spool by the annular flange.

In accordance with one embodiment of the invention, the tubing mandrel comprises a tubing mandrel body having an upper annular shoulder adapted to rotatably retain a tubing bowl nut. An outer contour below the annular shoulder is adapted for mating engagement with the tubing bowl, and an axial passage that extends from the tubing mandrel top end to the tubing mandrel bottom end of the tubing mandrel body has a diameter at least as large as an internal diameter of a production tubing of a well to which the tubing head spool is mounted. The tubing mandrel top end extends above the annular shoulder and includes a pin thread adapted for engagement with a box thread of a lockdown nut for securing a high pressure line to the tubing mandrel top end to permit well stimulation fluids to be pumped through the production tubing into the well to which the wellhead is mounted.

The system in accordance with the invention therefore provides a safe, efficient set of components for an independent screwed wellhead that permits a well equipped with the wellhead to be rapidly and efficiently completed or re-completed, while ensuring that stresses on the well stimulation tool and wellhead components do not exceed engineered limits. Safety is therefore significantly improved. In addition, full-bore access permits multi-zone completion or re-completion without cost-incurring delays associated with prior art methods of completing or re-completing such wells.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention provides a casing mandrel with a well stimulation tool and tubing head spool for use with the casing mandrel to facilitate and improve the efficiency of completing and/or re-completing wells equipped with independent screwed wellheads. Efficiency is improved by providing full-bore access to a casing of the well. Safety is improved by ensuring that stress on connection points of an injection tool use for well stimulation procedures does not exceed engineered stress tolerances at the connection points.

Figure 1:
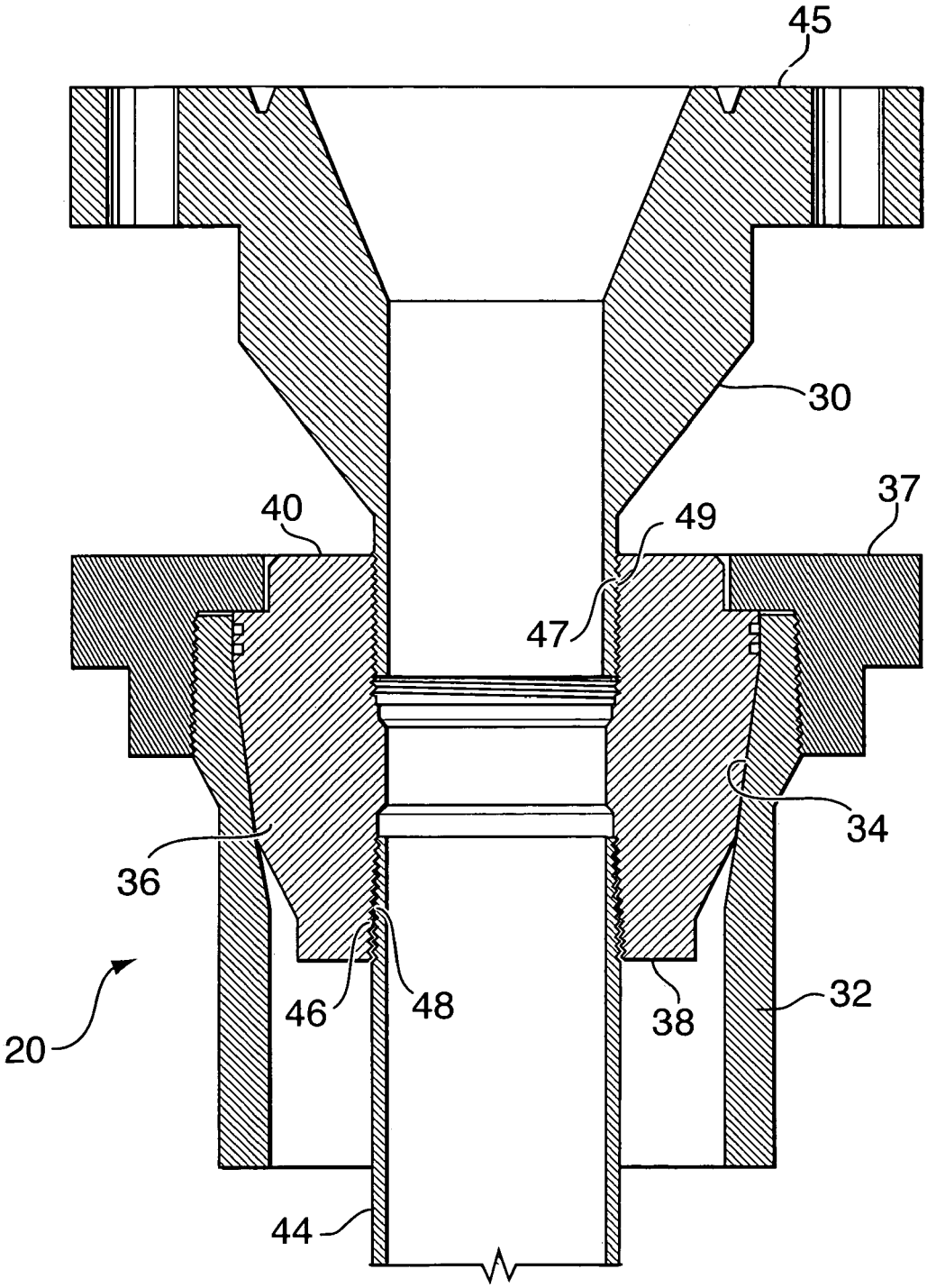
FIG. 1 PRIOR ART
FIG. 1 is a schematic cross-sectional view of an independent screwed wellhead equipped with a flanged casing pin adaptor in accordance with the prior art.
Figure 2:
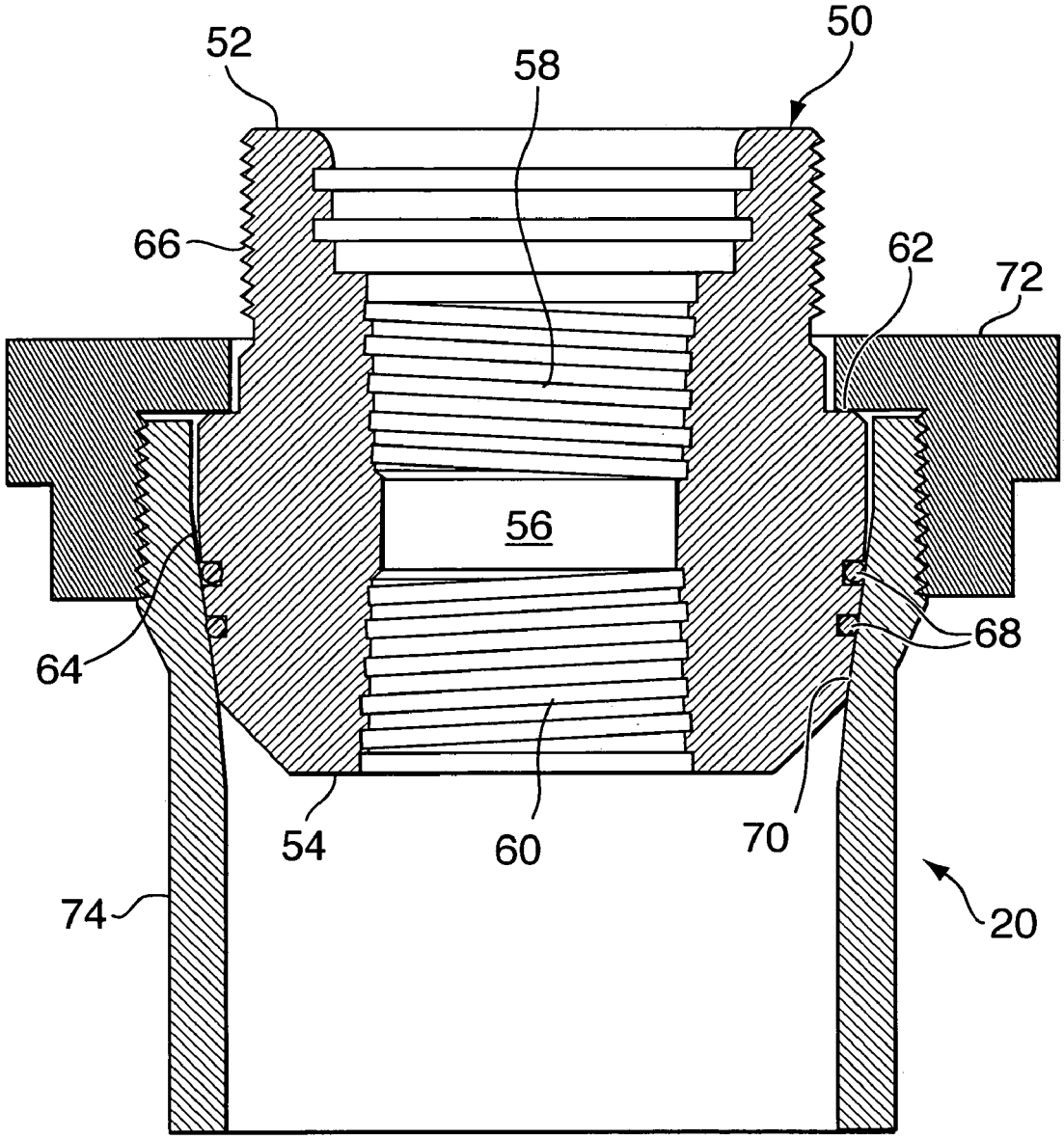
FIG. 2 is a schematic cross-sectional view of the independent screwed wellhead equipped with a casing mandrel in accordance with the invention.

FIG. 2 is a schematic cross-sectional view of an independent screwed wellhead 20 equipped with a casing mandrel 50 in accordance with the invention. The casing mandrel 50 includes a casing mandrel top end 52 and a casing mandrel bottom end 54 with an axial passage 56 that extends between the casing mandrel top end 52 and the casing mandrel bottom end 54. The axial passage 56 has a diameter at least at large as an internal diameter a casing connected to the casing mandrel 50. A top end of the axial passage 56 includes a top end box thread 58 and a bottom end of the axial passage 56 includes a bottom end box thread 60. A casing having a complementary pin thread is threadedly connected to the bottom end 54 of the casing mandrel 50 in a manner well known in the art. The casing mandrel further includes an annular shoulder 62. A casing bowl 70 of the independent wellhead receives the casing mandrel 50. The casing mandrel 50 is retained in the casing bowl 70 by a casing bowl nut 72 that engages the annular shoulder 62. The casing mandrel 50 further includes a pin thread 66 on an outer surface of the casing mandrel 50 that extends above a top of the casing bowl nut 72. The pin thread 66 provides an attachment point for a lockdown nut, as will be explained below with reference to FIGS. 3–7. An outer contour 64 of the casing mandrel 50 below the annular shoulder 62 mates with a contour of the casing bowl 70. At least one annular groove 68 in the casing mandrel 50 retains an elastomeric seal, such as an O-ring, to provide a fluid seal between the outer contour 64 of the casing mandrel 50 and an inner surface of the casing bowl 70.

Figure 3A:
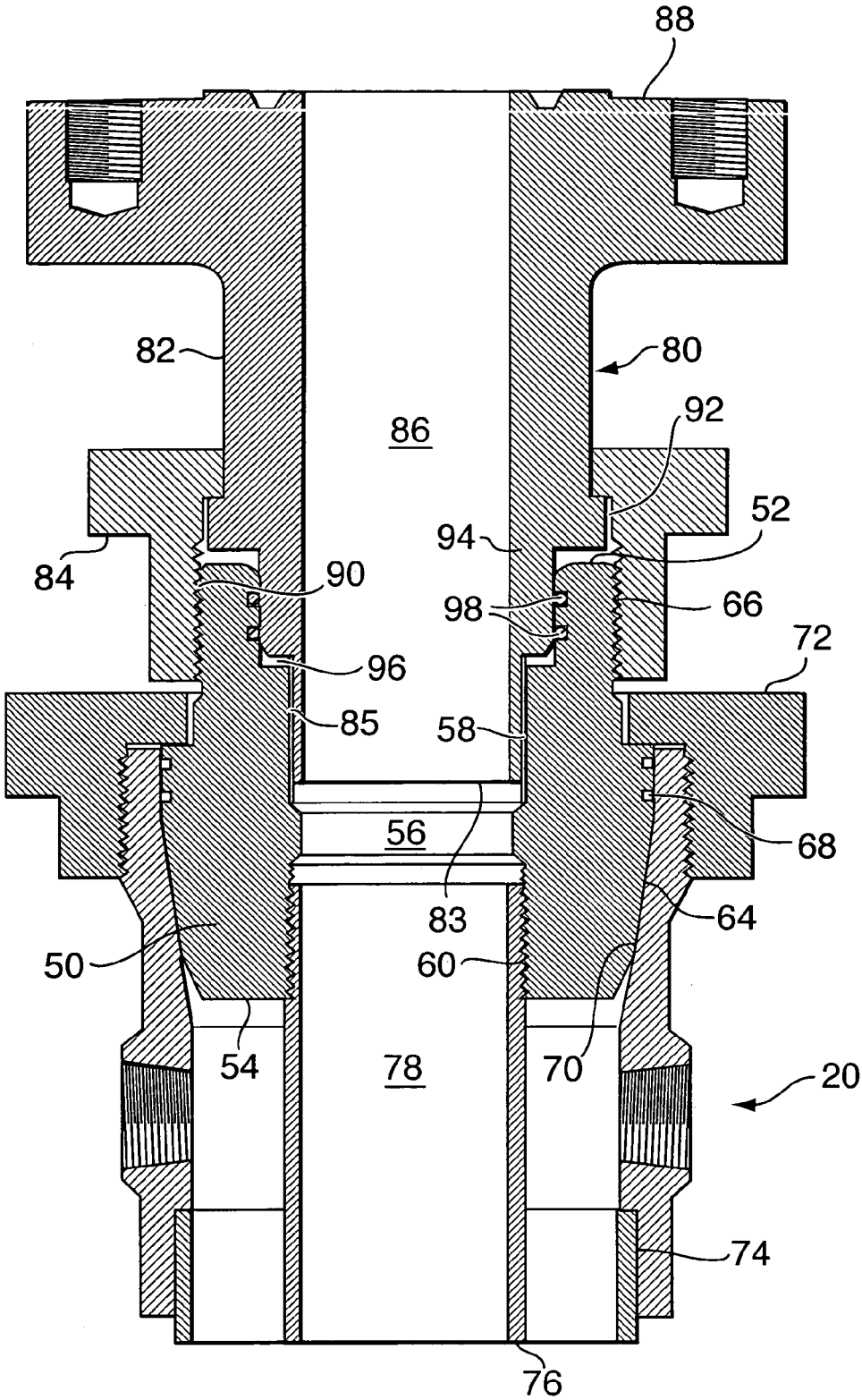
FIG. 3*a* is a schematic cross-sectional view of a first embodiment of a well stimulation tool, in accordance with a further aspect of the invention, connected to the casing mandrel shown in FIG. 2.

FIG. 3*a* is a cross-sectional schematic view of a well stimulation tool in accordance with a first embodiment of the invention connected to the casing mandrel 50 shown in FIG. 2. The independent screwed wellhead 20 is mounted to a surface casing 74 in a manner well known in the art. A production casing 76 having an internal diameter 78 threadedly engages the box thread 60 of the casing mandrel 50. A well stimulation tool 80 is mounted to a top of the casing mandrel 50. The well stimulation tool 80 includes a well stimulation tool mandrel 82 with a bottom end 83 having a pin thread 85 that engages the top end box thread 58 of the casing mandrel 50. The well stimulation tool mandrel 82 has an internal diameter 86 that is the same as the internal diameter 78 of the production casing 76. The well stimulation tool mandrel 82 also has a top flange 88 to which a well fracturing assembly, commonly referred to as a "fracstack" is mounted, in a manner well known in the art. The well stimulation tool mandrel 82 further includes an annular flange 92 that supports a lockdown nut 84. The lockdown nut 84 has a box thread 90 that engages the pin thread 66 at the top of the casing mandrel 50 to lock the well stimulation tool 80 to the casing mandrel 50 and share the stress load placed on the box thread 58 and the pin thread 85. Furthermore, in order to ensure that high fluid pressures cannot leak past the threaded connection between the well stimulation tool mandrel 82 and the casing mandrel 50, the well stimulation tool 80 is provided with a secondary seal barrel 94 which is received in a secondary seal bore 96 in the top end 52 of the casing mandrel 50. At least one annular groove 98 in either the secondary seal barrel 94 or the secondary seal bore 96 retains an elastomeric seal, such as an O-ring, to provide a high pressure secondary seal to ensure that high pressure fluids cannot escape through the connection between the well stimulation tool 80 and the casing mandrel 50.

As will be appreciated by those skilled in the art, the well stimulation tool 80 provides full-bore access to the production casing 76. Consequently, plugs, packers, perforating guns, fishing tools, and any other downhole tool or appliance can be run through the well stimulation tool 80. In a multi-zone well this permits a rapid transition from the pumping of high pressure well stimulation fluids and other downhole processes, such as the setting of a wireline plug or packer to isolate a production zone; lubricating in a logging tool to locate a production zone; lubricating in a perforating gun to perforate a casing that runs through a production zone; or performing any downhole operation that requires full-bore access to the production casing 76 without disconnecting the well stimulation tool or a blowout preventor mounted to the top flange 88 of the well stimulation tool 80. Further speed and economy can be achieved by using an apparatus for perforating and stimulating oil wells as described in co-applicant's U.S. Pat. No. 6,491,098, which issued on Dec. 10, 2002, the specification of which is incorporated herein by reference.

The embodiment of the well stimulation tool shown in FIG. 3*a* can also be used in conjunction with a blowout preventer protector described in co-applicant's U.S. patent application Ser. No. 09/537,629 filed on Mar. 19, 2000, the specification of which is incorporated herein by reference, to permit a tubing string to be suspended in the well during well stimulation procedures. The tubing string may be used as a dead string to measure downhole pressures during well stimulation, or may be used as a fracturing string to permit well stimulation fluids to be pumped down the tubing string, and optionally down the annulus between the casing and the tubing string simultaneously.

Figure 3B:
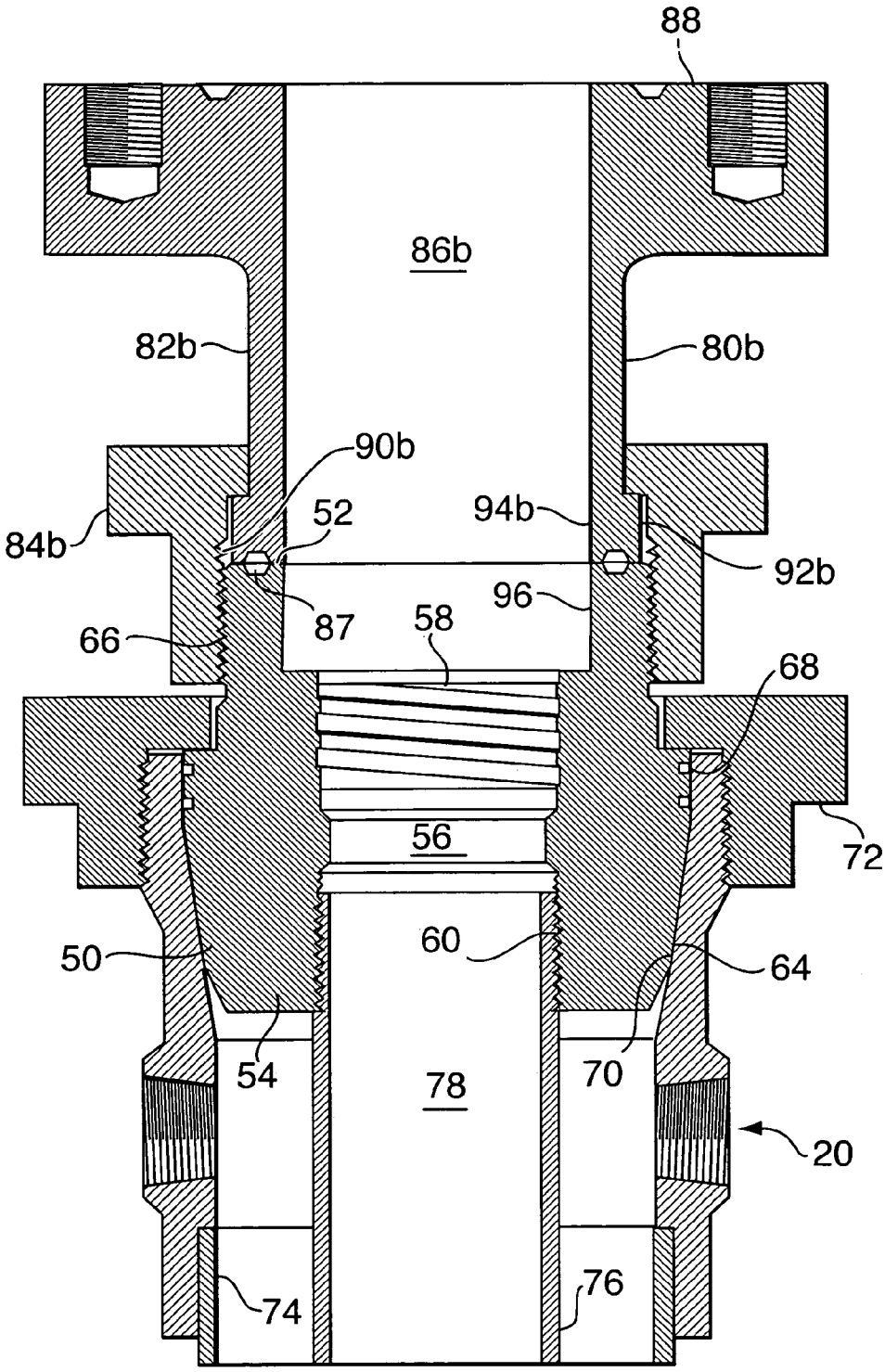
FIG. 3*b* is a schematic cross-sectional view of a second embodiment of the well stimulation tool shown in FIG. 3*a;*

FIG. 3*b* illustrates a second embodiment of the well stimulation tool in accordance with the invention connected to the casing mandrel 50 shown in FIG. 2. The well stimulation tool 80*b* is mounted to a top of the casing mandrel 50. The well stimulation tool 80*b* includes a well stimulation tool mandrel 82*b* with a bottom end 94*b* that includes an annular groove that mates with an annular groove 87 in the top end of the casing mandrel 50 for accommodating a high-pressure fluid seal, such as a ring gasket, which is well known in the art. The well stimulation tool mandrel 82*b* has an internal diameter 86*b* that is the same as an internal diameter of the secondary seal bore 96. The well stimulation tool mandrel 82 also has a top flange 88*b* to which a blowout preventer (not shown) can be mounted. A blowout preventer protector (not shown) is mounted to a top of the blowout preventer as described in co-applicant's U.S. Pat. No. 6,364,024, which issued Apr. 2, 2002, the specification of which is incorporated herein by reference. A mandrel of the blowout preventer protector is stroked down through the blowout preventer and an annular sealing body on the bottom end of the blowout preventer protector mandrel seals off against the secondary seal bore 96 in the casing mandrel 50. The annular sealing body provides a high pressure seal to ensure that high pressure well stimulation fluids cannot escape through the connection between the well stimulation tool 80*b* and the casing mandrel 50. The blowout preventer protector provides full-bore access to the well, and permits a tubing string to be suspended in the well during a well stimulation procedure.

The well stimulation tool mandrel 82*b* further includes an annular flange 92*b* that supports a lockdown nut 84*b*. The lockdown nut 84*b* has a box thread 90*b* that engages the pin thread 66*b* at the top of the casing mandrel 50 to lock the well stimulation tool 80*b* to the casing mandrel 50. As described in U.S. Pat. No. 6,364,024 the tubing string can be run through the blowout preventer protector into or out of a live well at any time, and if a tubing string is not in the well, any downhole tool can be run into or out of the wellbore.

If stimulation fluids laden with abrasive sand or other abrasive proppants are to be pumped into the well during a well stimulation procedure using the blowout preventer protector, the pin thread 58 of the casing mandrel 50 can be protected from erosion using a high pressure fluid seal for sealing against the secondary seal bore 96 as described in co-applicant's U.S. Pat. No. 6,247,537, which issued on Jun. 19, 2001. One embodiment of the high pressure fluid seal provides an inner wall that extends downwardly past the pin thread 58 of the casing mandrel 50 to prevent the pin thread 58 from being "washed out" by the abrasive proppants.

The lubrication of downhole tools into the production casing 76 can also be facilitated by use of a reciprocating lubricator as described in co-applicant's U.S. patent application Ser. No. 10/162,803 filed Jul. 30, 2002, the specification of which is likewise incorporated herein by reference.

After well completion is finished, a production tubing string is run into the well in order to produce hydrocarbons from the well. The production tubing string may be jointed tubing or coil tubing, each of which is well known in the art. In either case, the production tubing string must be supported in the well by a tubing head spool. In an independent screwed wellhead, the tubing head spool is supported by the casing mandrel 50. The invention therefore provides a tubing head spool specifically adapted for use with the casing mandrel 50 in accordance with the invention.

Figure 4:
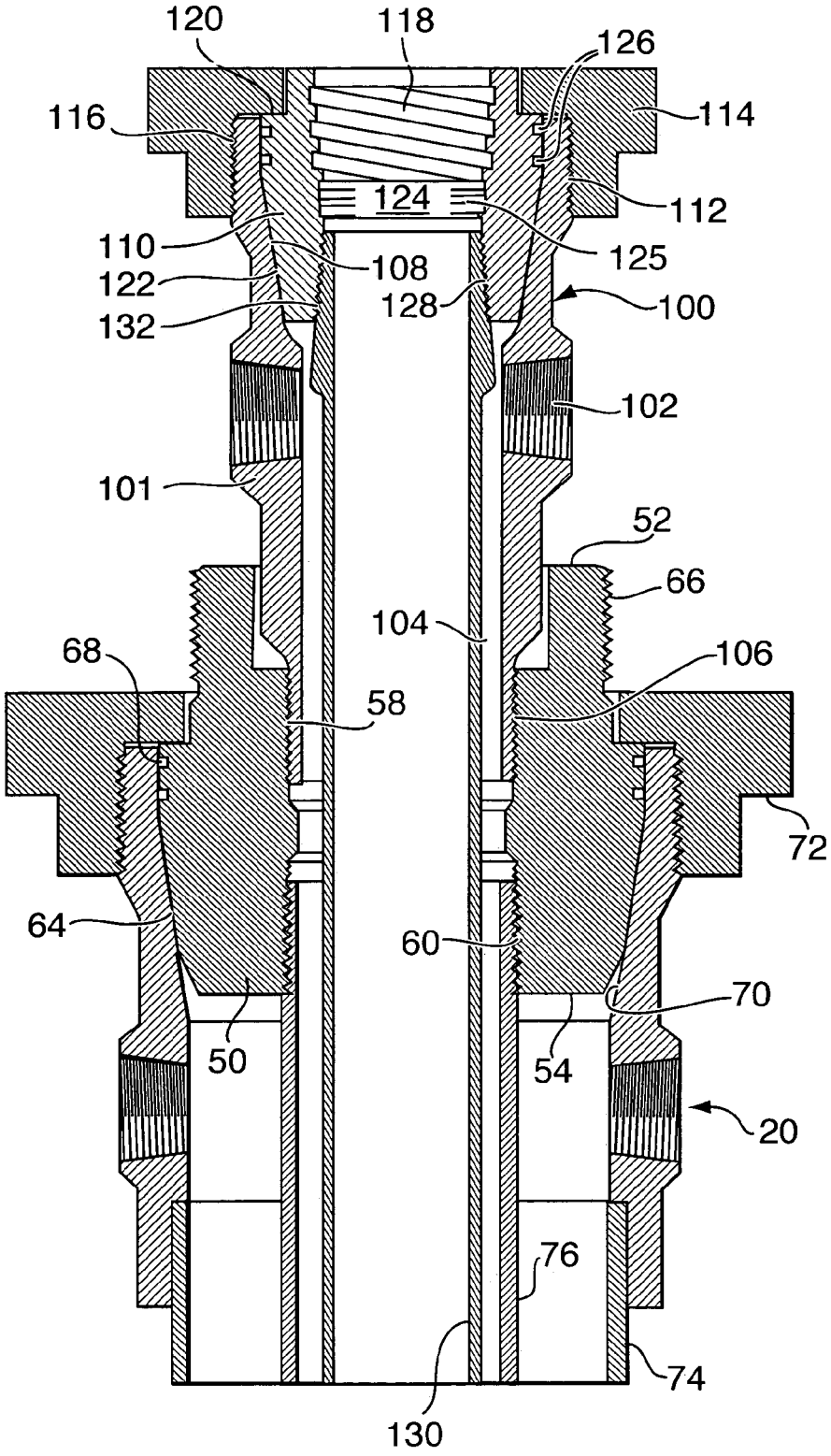
FIG. 4 is a cross-sectional view of a tubing head spool in accordance with a further aspect of the invention connected to the casing mandrel shown in FIG. 2.

FIG. 4 is a schematic cross-sectional view of an independent wellhead equipped with a tubing head spool 100 in accordance with the invention. The tubing head spool 100 has a sidewall 101 that includes one or more ports 102 that communicate with an axial passage 104. A bottom end of the sidewall 101 is machined with a pin thread 106 that engages the top end box thread 58 in the casing mandrel 50. A top end of the sidewall 101 includes a tubing bowl 108 that receives a tubing mandrel 110. The top end of the sidewall 101 includes an upper pin thread 112 which is engaged by a tubing bowl nut box thread 116 of a tubing bowl nut 114 that locks the tubing mandrel 110 in the tubing bowl 108. The tubing mandrel 110 includes an annular shoulder 120 engaged by a top flange of the tubing bowl nut 114 to the lock the tubing mandrel 110 in the tubing bowl 108. The tubing mandrel 110 has an outer contour 122 below the annular shoulder 120 that conforms to the shape of the tubing bowl 108. An axial passage 124 through the tubing mandrel 110 is at least as large as inner diameter of a production tubing 130 used to produce hydrocarbons from the well. A center region of the axial passage 124 may include backpressure threads 125, which are known in the art. The backpressure threads 125 permit a backpressure plug to be inserted into the tubing mandrel 110 to provide a fluid seal at a top of the tubing string 130. This facilitates oil and gas well servicing operations, as described in co-applicant's U.S. patent application Ser. No. 10/336,911, filed Jan. 6, 2003 and entitled BACKPRESSURE ADAPTER PIN AND METHODS OF USE, the specification of which is incorporated herein by reference.

At least one annular groove 126 in an outer surface of the tubing mandrel 110 accommodates an elastomeric seal, for example an O-ring, for providing a fluid seal between the tubing bowl 108 and the outer contour 122 of the tubing mandrel 110. The axial passage 124 includes a lower box thread 128 engaged by a production tubing pin thread 132 at a top of the production tubing string 130.

Figure 5:
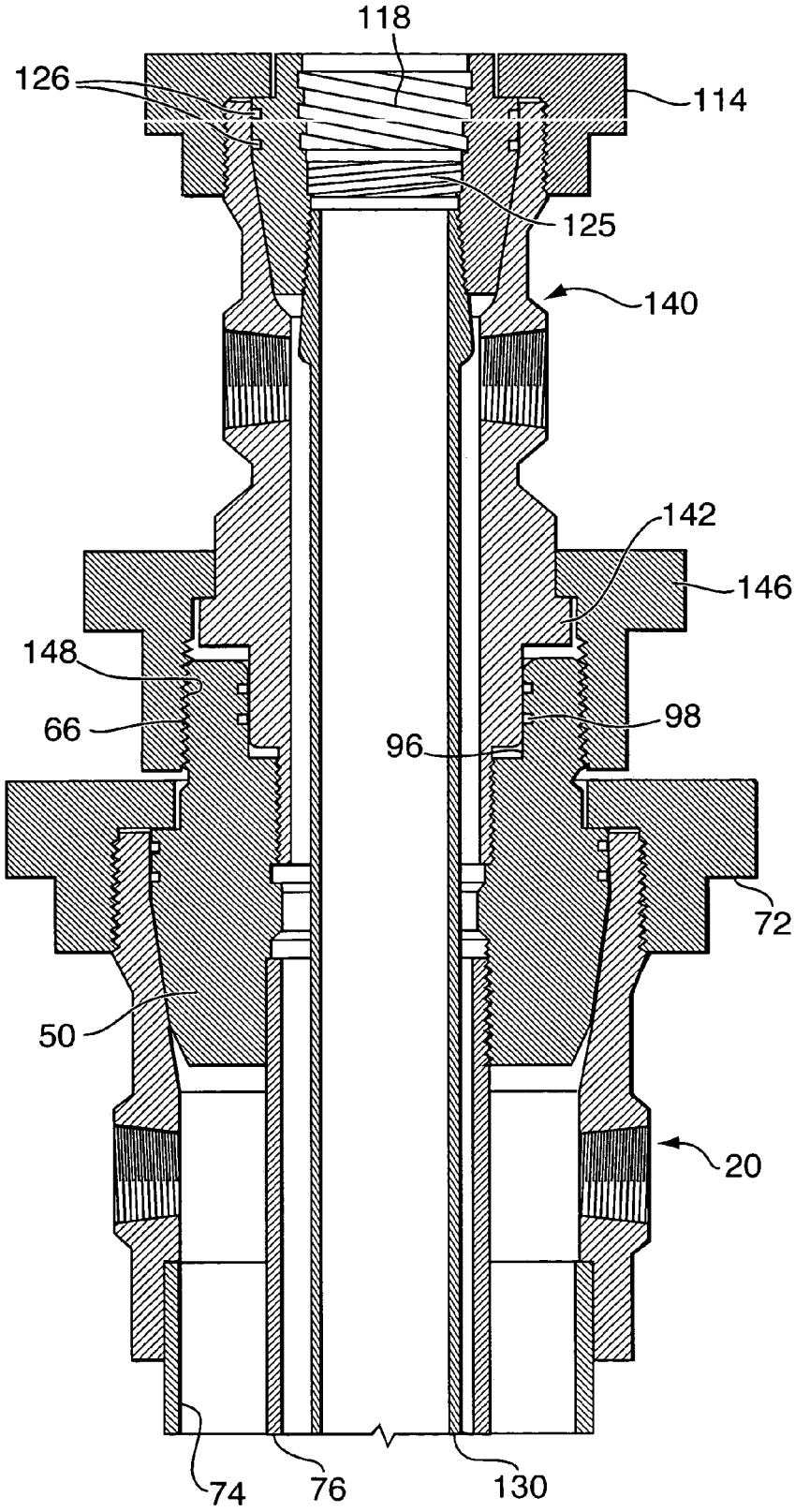
FIG. 5 is a schematic cross-section view of another embodiment of the tubing head spool in accordance with the invention.

FIG. 5 shows another embodiment of a tubing spool head in accordance with the invention. The embodiment shown in FIG. 5 is identical to that shown in FIG. 4 with the exception that the tubing spool head 140 is specifically configured to permit well stimulation to be performed using the production tubing string 130. This is referred to in the industry as "fracing down the tubing". Such treatments may be used for a variety of purposes including de-scaling the production tubing 130; pumping proppants into the production zone to restore productivity from the well, etc. The tubing head 140 includes an annular flange 142 located above a secondary seal barrel 144 that is received in the secondary seal bore 96 of the casing mandrel. The annular grooves 98 in the secondary seal bore 96 retain elastomeric seals for providing high pressure fluid seal between the secondary seal barrel 144 and the secondary bore 96, as explained above in detail. The connection of the tubing head spool 140 to the casing mandrel 50 is reinforced by a lockdown nut 146 having a box thread 148 that engages the pin thread 66 on the top end of the casing mandrel 50. Consequently, the tubing head 140 is secured against wracking forces and able to withstand fluid pressures up to the burst pressure of the production casing 76.

Figure 6:
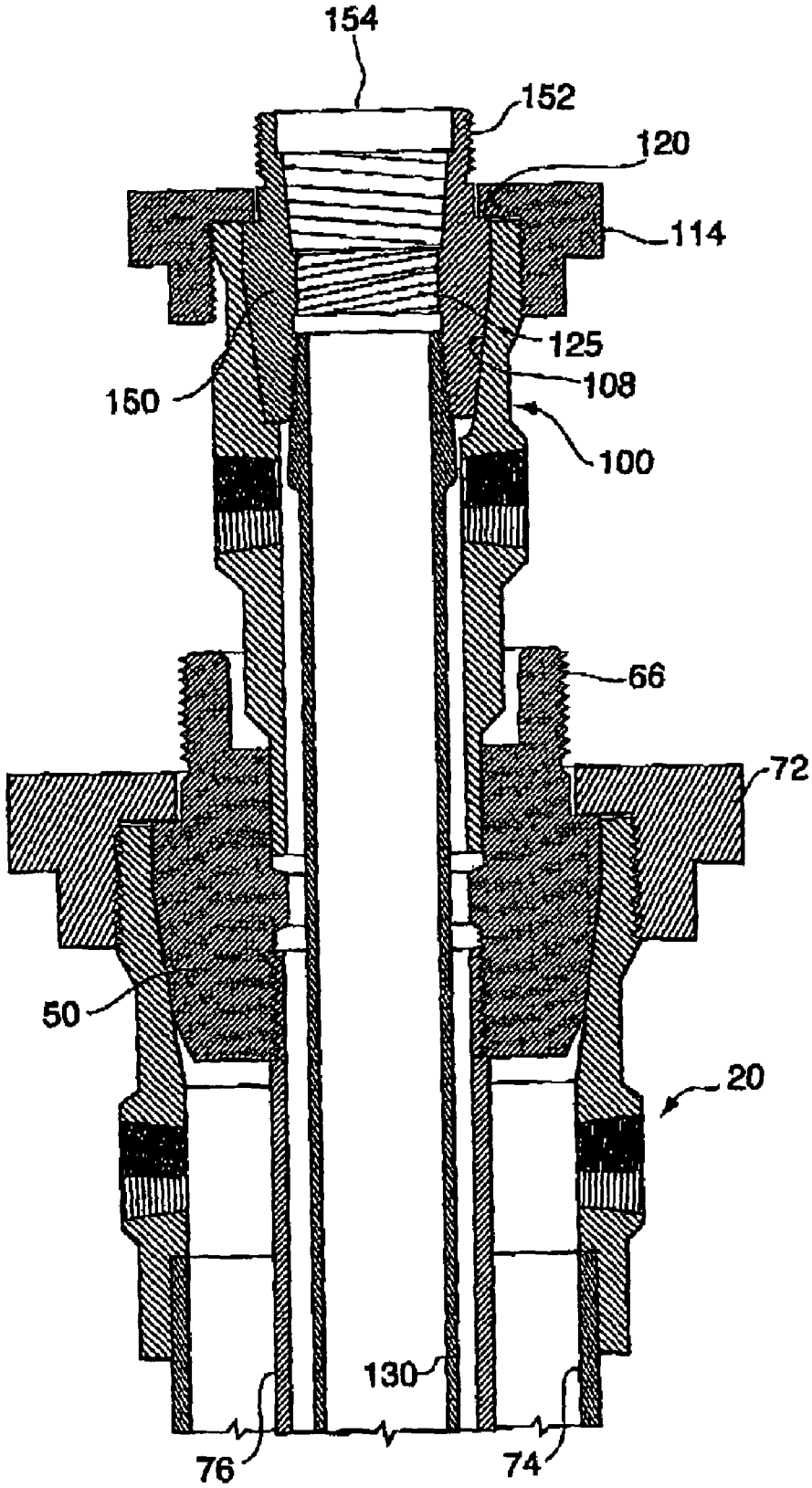
FIG. 6 is a cross-sectional view of yet another embodiment of the tubing head spool in accordance with the invention.

FIG. 6 is a cross-sectional schematic diagram of another configuration of a tubing mandrel 150 in accordance with the invention. The tubing mandrel 150 is supported in the tubing bowl 108 as explained above with reference to FIG. 4. The remainder of the structure of the tubing head spool 100 is identical to that described above. The tubing mandrel 150 is locked in the tubing bowl by a tubing bowl nut 114, as also described above. The difference between the tubing mandrel 140, and the tubing mandrel 150 is the tubing mandrel top end, which extends above the annular shoulder 120 and includes a pin thread 152 on the tubing mandrel top end 154. The pin thread 152 permits the connection of a well stimulation tool, a high pressure valve, and other flow control, wellhead or well completion elements required to produce from or stimulate production from the well.

Figure 7:
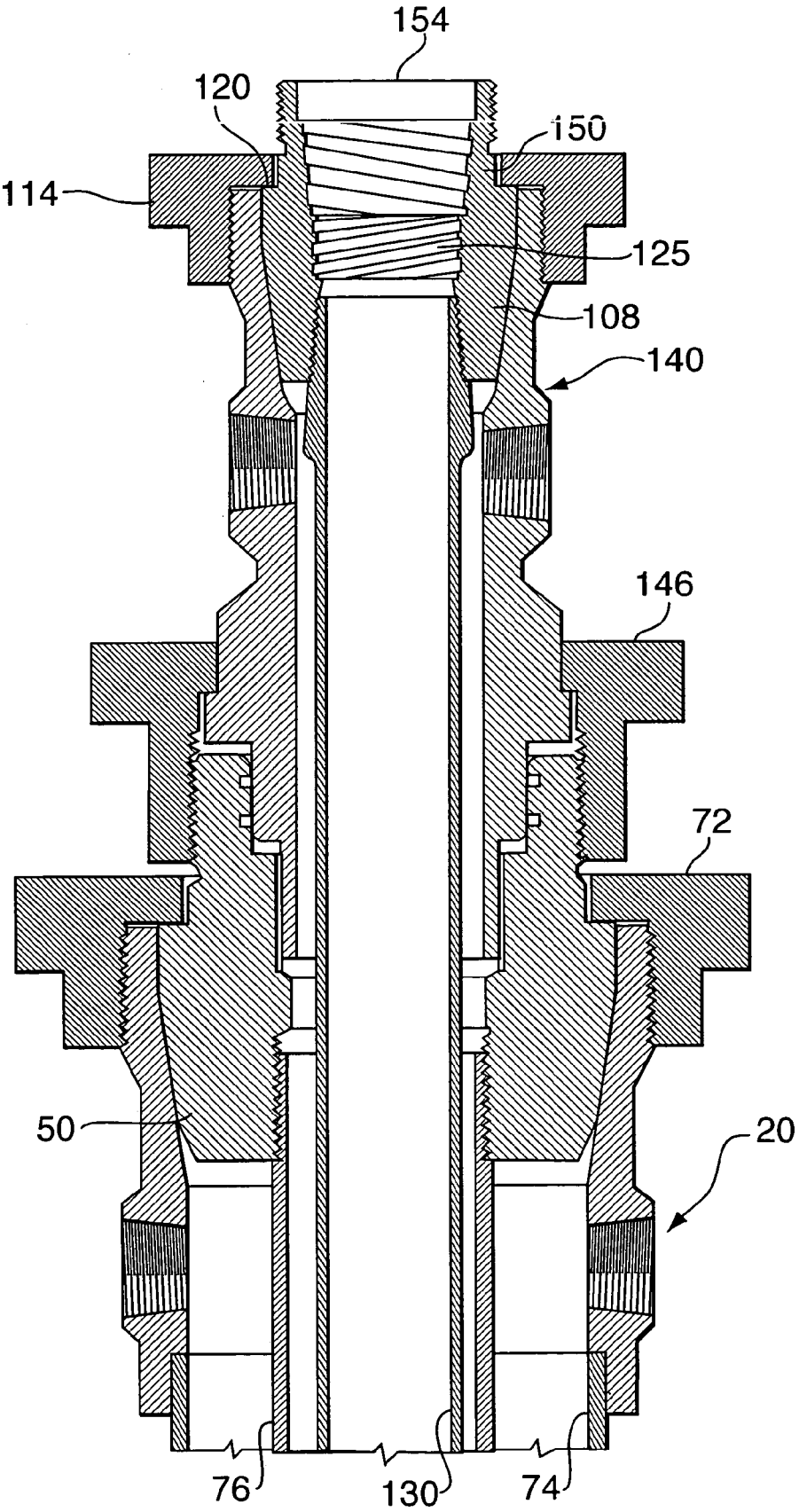
FIG. 7 is a cross-sectional view of another embodiment of the tubing head spool in accordance with the invention.

FIG. 7 is a cross-sectional diagram of yet another embodiment of a tubing head spool in accordance with the invention. The tubing head spool 140 is identical to that described above with reference to FIG. 5, with the exception of the tubing mandrel 150. The tubing bowl 108 supports a tubing mandrel 150, described above with reference to FIG. 6. The tubing head spool 140 provides all of the combined advantages of the embodiments of the invention described with reference to FIGS. 4–6.

Figure 8A:
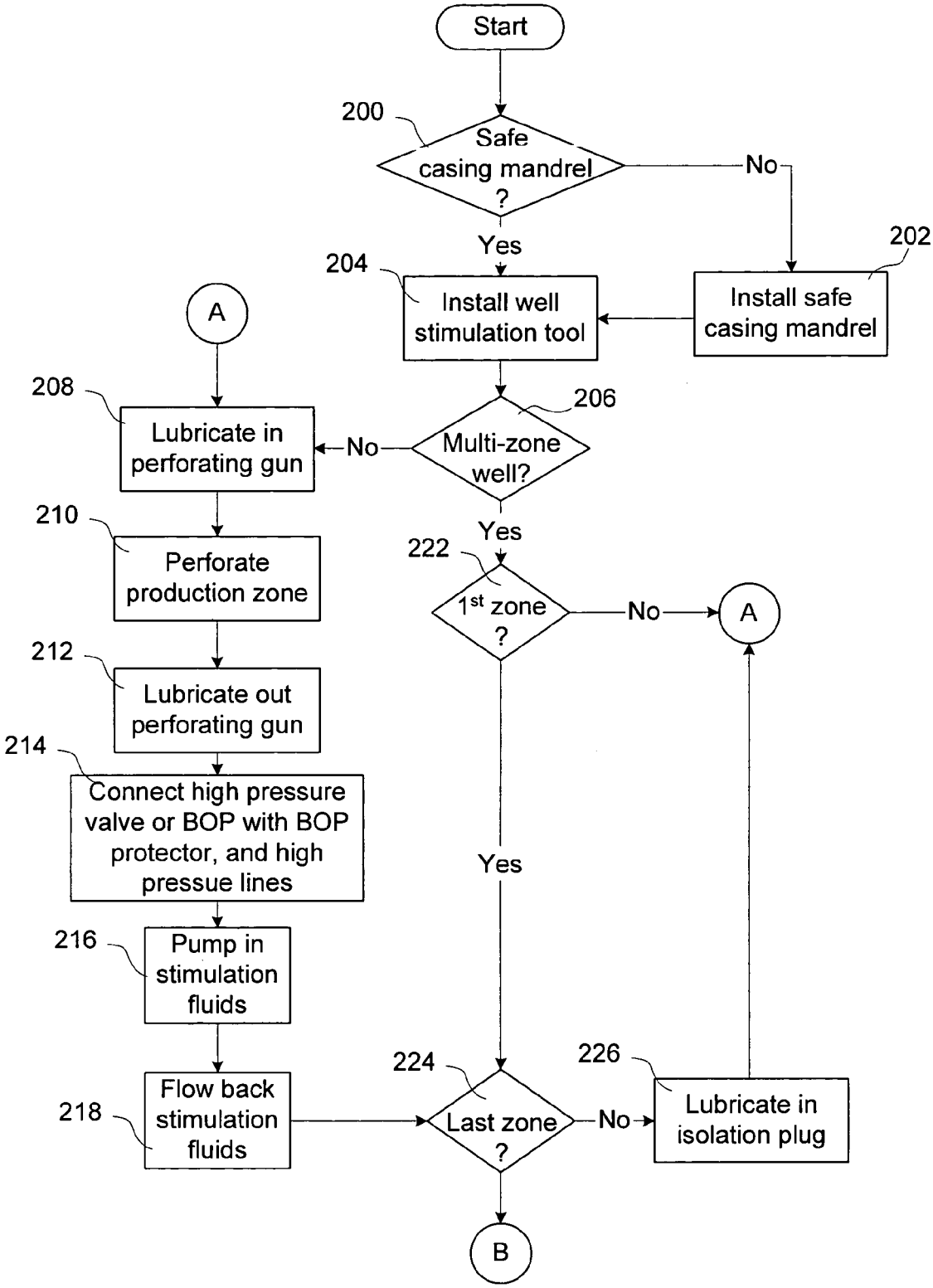
FIGS. 8*a* and 8*b* are a flow chart of an exemplary procedure for completing a hydrocarbon well using the apparatus and methods in accordance with the invention.
Figure 8B:
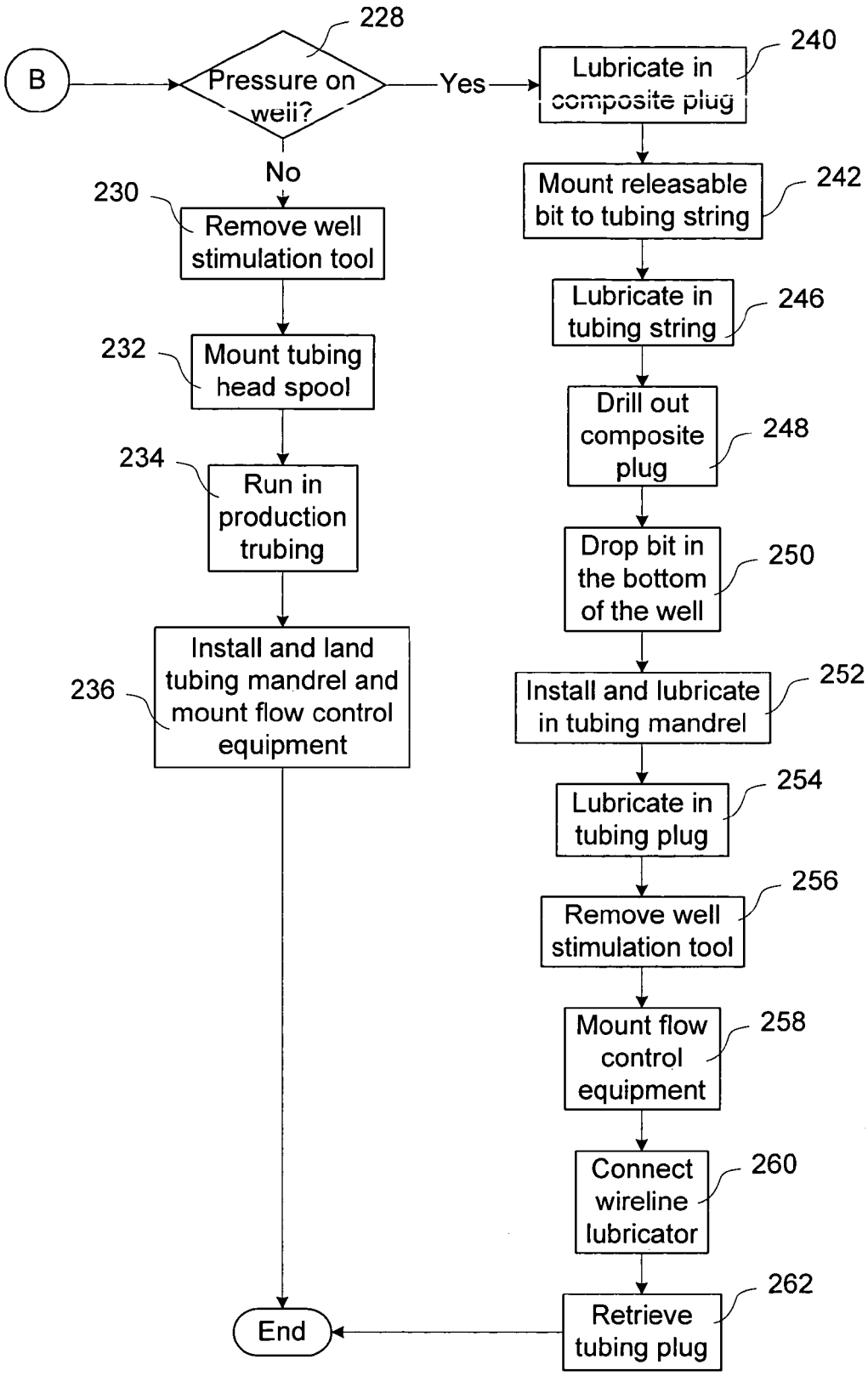

FIGS. 8*a* and 8*b* are a flow diagram that illustrates an exemplary use of the apparatus in accordance with the invention. In step 200 (FIG. 8*a*), an independent wellhead is inspected to determine whether it has been equipped with a casing mandrel 50 in accordance with invention. If it has not, the casing mandrel 50 is installed (step 202). One of the well stimulation tools described above with reference to FIGS. 3*a* and 3*b* is then mounted to the casing mandrel (step 204). In step 206 it is determined whether the well is a multi-zone well. This may be accomplished, for example, by logging the well using a logging tool in a manner well known in the art. If the well contains a single production zone, a perforating gun is lubricated into the casing in step 208 and the casing is perforated to open access to the production zone in step 210 using techniques well known in the art. After the casing has been perforated, which may require one or more loads of the perforating gun, the perforating gun is lubricated out of the well in step 212. A high pressure valve or a blowout preventer and a blowout preventer protector is/are then connected to the well stimulation tool (step 214), and high pressure fracturing lines are connected to the high pressure valve or the blowout preventer protector. Stimulation fluids are pumped into well in step 216 using methods and equipment well known in the art. As will be appreciated by those skilled in the art, the quantity and types of fluids injected into the wellbore depends on the characteristics and size of the production zone. After the prescribed quantity of stimulation fluids have been pumped into the well, the stimulation fluids are "flowed back" in order to prepare the well for production (step 218). In step 224 it is determined whether the production zone just treated is the last production zone. If not, the procedure branches to step 226 in which an isolation plug is lubricated into the well and steps 208–218 are repeated. If the last production zone has been treated, the procedure branches to step 228, as will be explained below in detail.

If it was determined step 206 that the well is a multi-zone well, in step 222 it is determined whether this is the first production zone of the well to be treated. If so, the procedure branches to step 208 and steps 208–218 described above are performed. If not, it is determined in step 224 whether the zone to be treated is the last production zone of the well. If it is not the last production zone, an isolation plug is lubricated into the well in step 226 to isolate a production zone just treated from a next production zone to be treated. The procedure then branches to step 208 and steps 208–218 are performed as described above. If the last production zone of the well has been treated, it is determined that in step 228 (FIG. 8*b*) whether there is natural pressure in the well resulting from a flow of hydrocarbons from the treated zone(s). If there is no natural pressure on the well, the well stimulation tool and the high pressure valve (or the blowout preventer and blowout preventer protector) are removed in step 230 and one of the tubing head spools described above with reference to FIGS. 4–7 is mounted to the casing mandrel (step 232). The production tubing is then run into the well (step 234) a tubing mandrel is installed at the top of the production tubing string and the tubing mandrel is landed in the tubing head spool (step 236). Flow control equipment is mounted to the tubing head spool, and the procedure terminates.

If there is pressure on the well, however, a composite plug is lubricated into the well in step 240 to seal the casing. An overbearing fluid, such as water, may also be pumped into the well bore, as will be understood by those skilled in the art. Thereafter, a releasable bit is mounted to a tubing string to be lubricated into the well (step 242). The tubing string is then lubricated into the well in step 246 and rotated to drill out the composite plug using the releasable bit mounted to the tubing string in step 242 (step 248). Once the composite bit has been drilled out, the releasable bit is dropped into the bottom of the well (step 250) and, if required, the tubing is run a required depth into the well. Thereafter, a tubing mandrel is installed on the top of the tubing string and lubricated into the well using, for example, co-applicant's apparatus for inserting a tubing hanger into a live well described in U.S. patent application Ser. No. 09/791,980 filed on Feb. 23, 2001, the specification of which is incorporated herein by reference. After the tubing mandrel is lubricated into the well, a plug is lubricated into the production tubing using, for example, a wireline lubricator (step 254). Once the tubing is sealed, the well stimulation tool is removed from the well (step 256) and flow control equipment is mounted to the tubing head (step 258). A wireline lubricator is then connected to the flow control equipment (step 260) and the tubing plug is retrieved in step 262. The well is then ready for production, and normal production can commence.

As will be understood by those skilled in the art, the procedure for completing wells described with reference to FIGS. 8*a*–*b* is exemplary only and does not necessarily describe all of the steps required during a well completion procedure.

As will be further understood by those skilled in the art, well completion is exemplary of only one procedure that can be practiced using the methods and apparatus in accordance with the invention. The method and apparatus in accordance with the invention can likewise be used for well re-completion, well stimulation, and any other downhole procedure that requires full-bore access to the production casing and/or production tubing of the well.

The embodiments of the invention described above are therefore intended to be exemplary only. The scope of the invention is intended to be limited solely by the scope of the appended claims.

We claim:

1. A tubing head spool for use on a well completed using an independent screwed wellhead and equipped with a casing mandrel having a casing mandrel top end that includes a pin thread, an axial passage through the casing mandrel and a box thread in a top end of the axial passage, the tubing head spool comprising:

a spool sidewall with a bottom end having a pin thread that engages the box thread in the top end of the axial passage through the casing mandrel;

at least one port through the sidewall that communicates with the axial passage;

a top end that includes a tubing bowl;

a tubing mandrel adapted to be received in the tubing bowl;

a tubing bowl nut having a top flange for locking the tubing mandrel in the tubing bowl, the tubing bowl nut threadedly engaging a pin thread at a top of the sidewall of the tubing head spool;

an annular flange located above the pin thread adapted to engage the box thread in the top end of the axial passage; and a lockdown nut adapted for threadedly engaging the pin thread on the casing mandrel top end to lock the tubing head spool to the casing mandrel, the lockdown nut being rotatably retained on the tubing head spool by the annular flange.

2. The tubing head spool as claimed in claim 1 further comprising a secondary seal barrel located above the pin thread on the bottom end of the spool sidewall and below the annular flange, the secondary seal barrel being adapted to be received in a secondary seal bore in the casing mandrel top end.

3. The tubing head spool as claimed in claim 2 wherein one of the secondary seal barrel and the secondary seal bore includes at least one annular groove in an external surface thereof for receiving and retaining an elastomeric seal for providing a fluid seal between the secondary seal bore and the secondary seal barrel.

4. The tubing head spool as claimed in claim 3 wherein the elastomeric seal is an O-ring.

5. The tubing head spool as claimed in claim 1 wherein the tubing mandrel comprises:

a tubing mandrel body having an annular shoulder adapted to rotatably retain the tubing bowl nut, an outer contour below the annular shoulder being adapted for mating engagement with the tubing bowl, and an axial passage that extends from the tubing mandrel top end to a tubing mandrel bottom end of the tubing mandrel body, the axial passage having a diameter at least as large as an internal diameter of a production tubing of a well to which the wellhead is mounted; and the tubing mandrel top end extends above the annular shoulder, the tubing mandrel top end including a pin thread adapted for engagement with a box thread of a lockdown nut for securing a well stimulation tool to the tubing mandrel top end to permit well stimulation fluids to be pumped through the production tubing into the well to which the wellhead is mounted.

6. The tubing head spool as claimed in claim 5 wherein the tubing mandrel further comprises at least one annular groove adapted to receive an elastomeric seal for providing a fluid seal between the tubing bowl and the tubing mandrel.

7. A casing mandrel adapted to improve the safety of high-pressure well stimulation procedures on wells completed using an independent screwed wellhead, comprising:

a casing mandrel body having an annular shoulder adapted for mating engagement with a top flange of a casing bowl nut of the wellhead, an outer contour below the annular shoulder being adapted for mating engagement with a casing bowl of the wellhead, and an axial passage that extends from a casing mandrel bottom end to a casing mandrel top end of the casing mandrel body, the axial passage having a diameter at least as large as an internal diameter of a casing of a well to which the wellhead is mounted; and the casing mandrel top end extends above the annular shoulder, and includes a pin thread adapted for engagement with a box thread of a well stimulation tool lockdown nut for securing the well stimulation tool against the casing mandrel top end, and the casing mandrel toop end further includes an annular groove that mates with an annular groove in a bottom end of the well stimulation tool, the mated annular grooves accommodating a high pressure fluid seal.

8. The casing mandrel as claimed in claim 7 wherein the high pressure fluid seal is a metal ring gasket.

* * * * *

UNITED STATES PATENT AND TRADEMARK OFFICE

CERTIFICATE OF CORRECTION

PATENT NO. : 7,066,269 B2
APPLICATION NO. : 10/440795
DATED : June 27, 2006
INVENTOR(S) : L. Murray Dallas and Bob McGuire It is certified that error appears in the above-identified patent and that said Letters Patent is hereby corrected as shown below:

In the specification:
Column 1, line 62, please delete “993,488” and replace with --4,993,488--.
Column 5, line 23, please delete “at” and replace with --as--.
Column 5, line 23, after “diameter” please insert --of--.
Column 7, line 54, after “to” please delete “the”.

In the claims:
Column 12, line 19, please delete “toop” and replace with --top--.

Signed and Sealed this

Thirteenth Day of May, 2008

JON W. DUDAS
*Director of the United States Patent and Trademark Office*